US006437698B1

(12) United States Patent
Byrne et al.

(10) Patent No.: US 6,437,698 B1
(45) Date of Patent: Aug. 20, 2002

(54) SMOKE ALARM DEVICE

(75) Inventors: Michael Byrne; James Duignan; Keith Fawcett, all of Limerick; Fergus Flynn, Newmarket-on-Fergus; Michael Guinee, Limerick, all of (IE)

(73) Assignee: E.I. Technology Limited, Shannon (IE)

( * ) Notice: Subject to any disclaimer, the term of this patent is extended or adjusted under 35 U.S.C. 154(b) by 0 days.

(21) Appl. No.: 09/705,745

(22) Filed: Nov. 6, 2000

(30) Foreign Application Priority Data

Nov. 5, 1999 (IL) ..... 990927

(51) Int. Cl.[7] ..... G08B 17/10

(52) U.S. Cl. ..... 340/630; 340/628; 340/629; 340/588; 340/589

(58) Field of Search ..... 340/628, 630, 340/629, 588, 589

(56) References Cited

U.S. PATENT DOCUMENTS

| | | | | |
|---|---|---|---|---|
| 4,086,574 A | | 4/1978 | Miyabe | 340/227 |
| 4,757,303 A | | 7/1988 | Scheidweiler | 340/501 |
| 4,897,634 A | | 1/1990 | Sawa et al. | 340/630 |
| 5,019,805 A | * | 5/1991 | Curl et al. | 340/628 |
| 5,523,743 A | * | 6/1996 | Rattman et al. | 340/630 |
| 5,691,704 A | | 11/1997 | Wong | 340/628 |
| 5,798,701 A | * | 8/1998 | Bernal et al. | 340/628 |
| 6,064,064 A | * | 5/2000 | Castleman | 340/578 |

FOREIGN PATENT DOCUMENTS

JP 10-241075 9/1998

* cited by examiner

*Primary Examiner*—Jeffery Hofsass
*Assistant Examiner*—Hung Nguyen
(74) *Attorney, Agent, or Firm*—Jacobson Holman, PLLC

(57) ABSTRACT

A smoke alarm device has an ASIC (1) with an integrated photo detector (3) and control circuit. The photo detector output is compared every ten seconds with an alarm threshold level in a comparator circuit (10), with a sensitivity-decrease threshold in a comparator circuit (11), and with a sensitivity-increase threshold in a comparator circuit (12). A logic block (2) causes sensitivity to be increased or decreased in which decreases take place at intervals of six hours and increases take place after 40 secs. The logic block (2) provides for least sensitivity at power-up with rapid increases to the appropriate level according to the level of back-scatter caused by dust contamination. The logic block (2) maintains a high signal on an interconnect terminal (9) for four seconds after a test button (7) is pressed so that a maintenance person can hear remote interconnected devices after the local device has stopped sounding. The logic block (2) also stores a memory flag when is goes into alarm mode and modulates the horn at a different frequency at the next testing to indicate that it has historically sensed smoke since last tested.

22 Claims, 3 Drawing Sheets

SMOKE ALARM DEVICE

INTRODUCTION

1. Field of the Invention

The invention relates to smoke alarm devices.

2. Prior Art Discussion

Typically, a smoke alarm device comprises a housing having vents to allow flow of surrounding air into and out of the housing, an alarm indicator means typically including a sound emitter (horn), a smoke sensor, and a control circuit which monitors the sensor output to determine if smoke is present and activates an alarm if smoke is present. The most common smoke sensors are of the optical and ioniser types.

Such smoke alarms have been available for many years and generally work quite effectively. However, there is a need to improve reliability without increasing costs and indeed there is general commercial pressure to progressively reduce costs to encourage the wide availability and use of smoke alarm devices.

Thus, the invention is directed towards providing for improved reliability in smoke alarm devices while at the same time reducing costs.

SUMMARY OF THE INVENTION

According to the invention, there is provided a smoke alarm device comprising:

a housing having vents to allow flow of surrounding air into and out of the housing, an alarm indicator means, a smoke sensor, and a control circuit comprising means for monitoring a sensor output, for determining if smoke is present, and for activating the alarm indicator if it is present, characterised in that, the sensor and the control circuit are integrated together in an integrated circuit mounted within the housing.

In one embodiment, the integrated circuit is an ASIC.

In one embodiment, the sensor comprises a photo-detector, and the alarm device further comprises an optical chamber comprising means for blocking ambient light, an internal light source, means for allowing the sensor to detect scattered light within the chamber, and means for allowing surrounding air to flow into the chamber.

In another embodiment, the integrated circuit further comprises a shielding case for the integrated circuit. said case comprising a window to provide a field of view for the sensor.

In one embodiment, the case comprises an integral earth terminal.

In one embodiment, the control circuit comprises means for dynamically adjusting sensitivity in response to sensing of back-scatter arising from dust contamination within the optical chamber.

In another embodiment, said sensitivity adjustment means comprises means for decreasing sensitivity only at least three hours after contamination has reached a sensitivity-decrease threshold level.

In a further embodiment, the sensitivity adjustment means comprises means for incrementing a counter every time contamination above said sensitivity-decrease threshold is detected and means for decreasing sensitivity when the counter value reaches a counter maximum value.

In one embodiment, said sensitivity-decrease threshold level is a proportion of an alarm threshold level which sets the alarm sensitivity.

In one embodiment, the sensitivity adjustment means comprises means for increasing sensitivity in response to contamination dropping below a sensitivity-increase level.

In one embodiment, the sensitivity adjustment means comprises means for increasing sensitivity within one minute of contamination dropping below the sensitivity-increase level.

In another embodiment the sensitivity adjustment means comprises means for increasing sensitivity in successive steps separated by less than one minute.

In one embodiment, the sensitivity adjustment means comprises means for adjusting sensitivity by changing a sensor output alarm threshold level.

In one embodiment, the sensitivity adjustment means comprises means for automatically setting the sensitivity at the least sensitive level on power-up.

In one embodiment, the control circuit comprises means for generating a user output indicating that the optical chamber needs to be cleaned if the contamination reaches a warning level.

In anther embodiment, said user output is a flashing LED.

In one embodiment, the control circuit comprises means for storing a flag when smoke is detected, and for subsequently, after the smoke has cleared, generating a memory indication that smoke was sensed.

In one embodiment, the control circuit comprises means for generating the memory indication in response to user testing of the device.

In one embodiment, the alarm indicator means comprises a sound emitter, and the memory indication is activation of the sound emitter at a different frequency than for indicating that smoke is being sensed.

In one embodiment, the control circuit comprises means for resetting the flag upon testing.

In another embodiment, the control circuit comprises an interconnect interface, and means for directing the interface to transmit a signal on an interconnect line for a time duration after it has stopped activating the alarm indicator means.

In a further embodiment, the control circuit comprises means for counting occurrences of a photo detector output exceeding an alarm threshold, and for activating an alarm mode when the count reaches a pre-set value.

In one embodiment, the control circuit comprises means for sampling light at periodic intervals and for decreasing said intervals after the first occurrence of the output exceeding the alarm threshold.

According to another aspect, the invention provides a smoke alarm device comprising:

a housing having vents to flow of surrounding air into and out of the housing, an alarm indicator means, a smoke sensor, and a control circuit comprising means for monitoring sensor output, for determining if smoke is present, and for activating the alarm indicator if is present, characterised in that, the sensor and the control circuit are integrated together in an ASIC, the sensor is a photo detector and the ASIC is connected to an optical chamber whereby the photo detector can sense scattered light caused by smoke present within the optical chamber, and the ASIC comprises means for comparing an output of the photo detector with an alarm threshold 11, with a sensitivity-decrease threshold, and with a sensitivity-increase threshold, and means for activating the alarm indicator means if a sensitivity level exceeds the alarm threshold level, for automatically decreasing sensitivity if the photo detector output exceeds the sensitivity-decrease level a preset number of times over a period exceeding three hours, and for automatically increasing sensitivity if the photo detector output is lower than the sensitivity-increase threshold within less than one minute.

DETAILED DESCRIPTION OF THE INVENTION

BRIEF DESCRIPTION OF THE DRAWINGS

The invention will be more clearly understood from the following description of some embodiments thereof, given by way of example only with reference to the accompanying drawings in which.

DESCRIPTION OF THE EMBODIMENT

Figure 1:
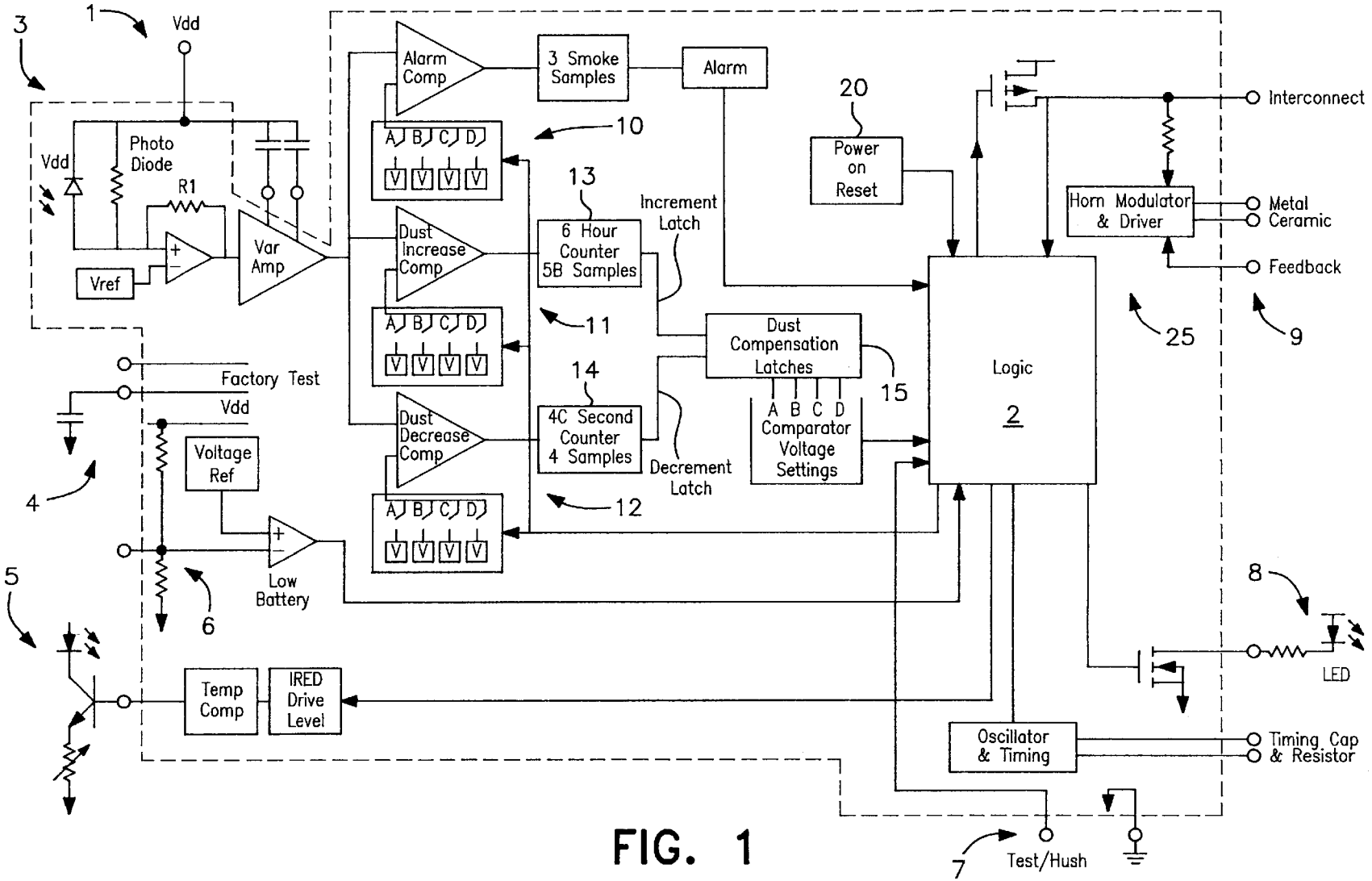
FIG. 1 is a diagram illustrating construction of a control circuit of a smoke alarm device of the invention.
Figure 3:
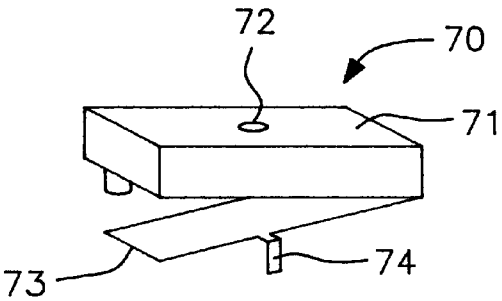
FIG. 3 is a perspective view of a shielding casing for the ASIC.

Referring to FIG. 1 there is shown a control circuit and sensor of a smoke alarm device. The control circuit and the sensor are integrated in an application specific integrated circuit (ASIC) in which the main logic functions are performed by a logic block 2 and the sensor is an integral photodiode 3. The ASIC has factory test terminals 4, battery power supply terminals 6 and Vdd, and a terminal connected to an infra red LED 5 for use in optical smoke sensing. There is also a test/hush button terminal 7, a terminal 8 for driving an alarm indicator LED, and a block of terminals 9 for an alarm indicator sound emitter (horn) and an interconnect line.

All of the functionality within the block indicated by the interrupted lines are integrated on the ASIC, including the photo detector 3. Thus, the control circuit and sensor are much less costly to produce than has heretofore been the case. There is less assembly work required and therefore less scope for faults. Another major advantage is that the circuit is much less prone to electrical interference because the photo diode's leads are attached directly to the high game amplifier input and so there is little scope for their use as "aerials" for electrical pick-up. This arrangement also allows use of larger value on-chip resistors with extremely low leakage.

The ASIC 1 comprises a comparator circuit 10 for comparison of the voltage signal from the photo detector circuit 3 with an alarm threshold set according to the required sensitivity. There is also a comparator circuit 11 which checks the photo detector output against a sensitivity-decrease threshold to allow for compensation for dust contamination. A comparator circuit 12 is connected for comparison of the photo detector output with a sensitivity-increase threshold to allow sensitivity to be increased after the device is cleaned. Each of the comparator circuits 10, 11, and 12 includes a counter for counting of occurrences of the photo detector output being above or below a relevant threshold, as described in more detail below. The alarm comparator circuit 10 feeds directly into the logic block 2, whereas the dust compensation comparator circuits 11 and 12 feed into dust contamination latches 5 which in turn feed into the logic block 2.

The ASIC 1 also comprises a Power on Reset circuit 20 connected to the logic block 2. This ensures that the device powers-up in a known defined state, with no spurious LED flashes or horn beeps to confuse the user. The factory terminals 4 allow the clock to be speeded up during manufacture in order to rapidly calibrate the device. It also allows other parameters such as battery trip points to be rapidly checked. The potential or the pin for the IRED 5 is temperature-compensated by the "Temp Comp" component because the light output decreases as temperature rises. The logic block 2 increases the gain so that background light in the optical chamber is detected when the test/hush button connected to the terminal 7 is pressed. This confirms that the chamber is operational. On releasing the button the device goes into hush mode only if it was in alarm mode before the button was pressed. This ensures that the device is not de-sensitised every time the test/hush button is pressed.

Figure 2:
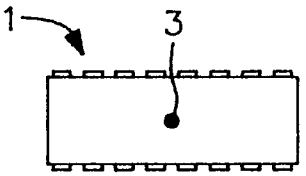
FIG. 2 is a plan view of an ASIC of the alarm device.

The ASIC 1 is shown in its physical form in plan view in FIG. 2. It will be seen that the photo detector 3 is mounted centrally in the top face of the ASIC. The area is 1 $mm^2$. The ASIC 2 is surrounded by a shielding casing 70 having a rectangular open box 71 with a window 72 for the photo detector 3. A lower hinged cover 73 allows the ASTC 1 to be inserted during manufacture and the cover 73 incorporates an earthing lead 74. The cover 73 is sufficiently wide to hold the ASIC 1 in place, however, it allows the leads of the ASIC 1 to extend out of the casing 70 for connection to the relevant circuit board.

Figure 4:
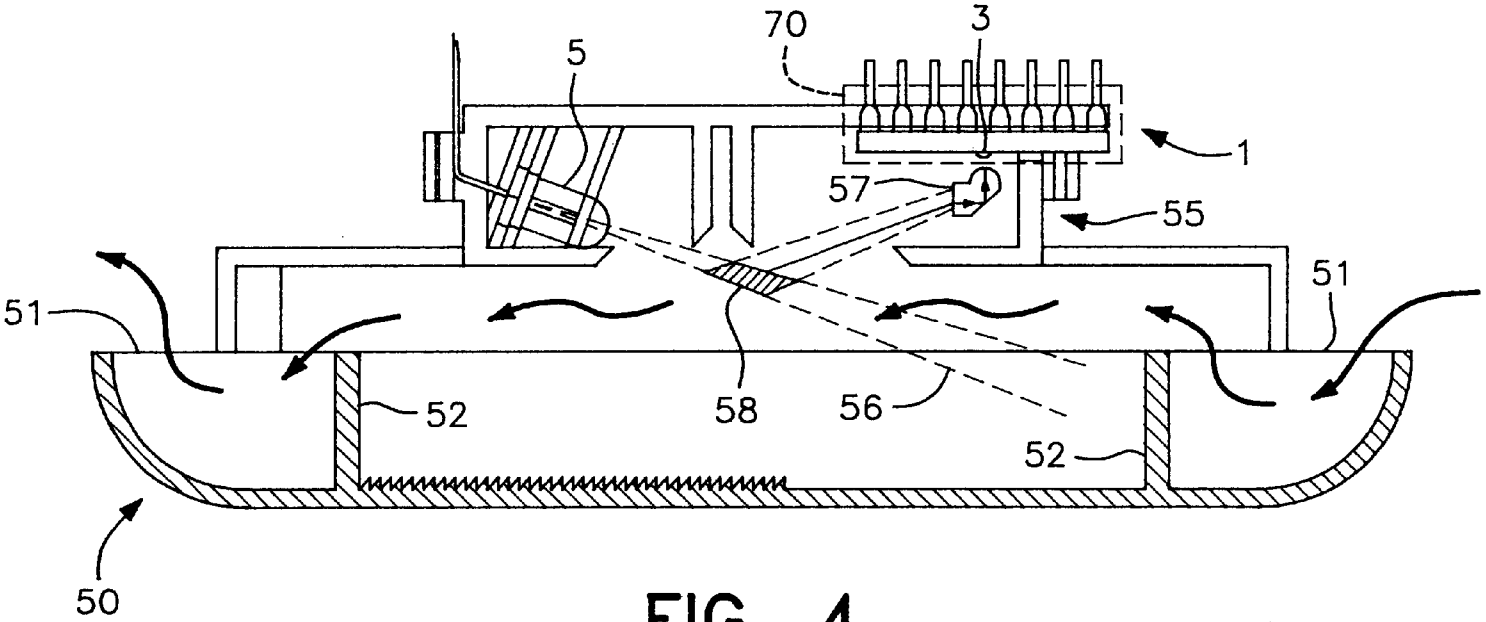
FIG. 4 is a diagrammatic cross-sectional view of an optical chamber of the alarm device.

Referring now to FIG. 4 the manner in which the ASIC 1 is mounted for optical smoke sensing is illustrated. An optical chamber 50 comprises an annular downwardly-depending duct 51 to allow passage of air which has passed through vents in the alarm device housing (not shown). The optical chamber 50 comprises air baffles 52 which act to both direct air upwardly towards a sensing space and also to help prevent ambient light from penetrating the chamber. The optical chamber 50 has a support structure 55 for the IRED 5 and for the ASIC 1. The IRED 5 generates an infra red beam 56 which extends across the field of view of the photo detector 3. Because the material of the optical chamber 50 is black there is little reflection of the internal surfaces, only a relatively low background level which is detected by the photo detector 3. The field of view of the photo detector 3 is focused into the photo detector 3 by a combined prism and lens 57 and it intersects with the beam 56 in the volume indicated by the numeral 58. When no smoke is present the photo detector 3 only senses the small level of radiation which is reflected from the internal surfaces of the optical chamber. However, when smoke is present the smoke particles scatter the light within the volume 58, resulting in increased light impinging on the photodetector 3.

Figure 5:
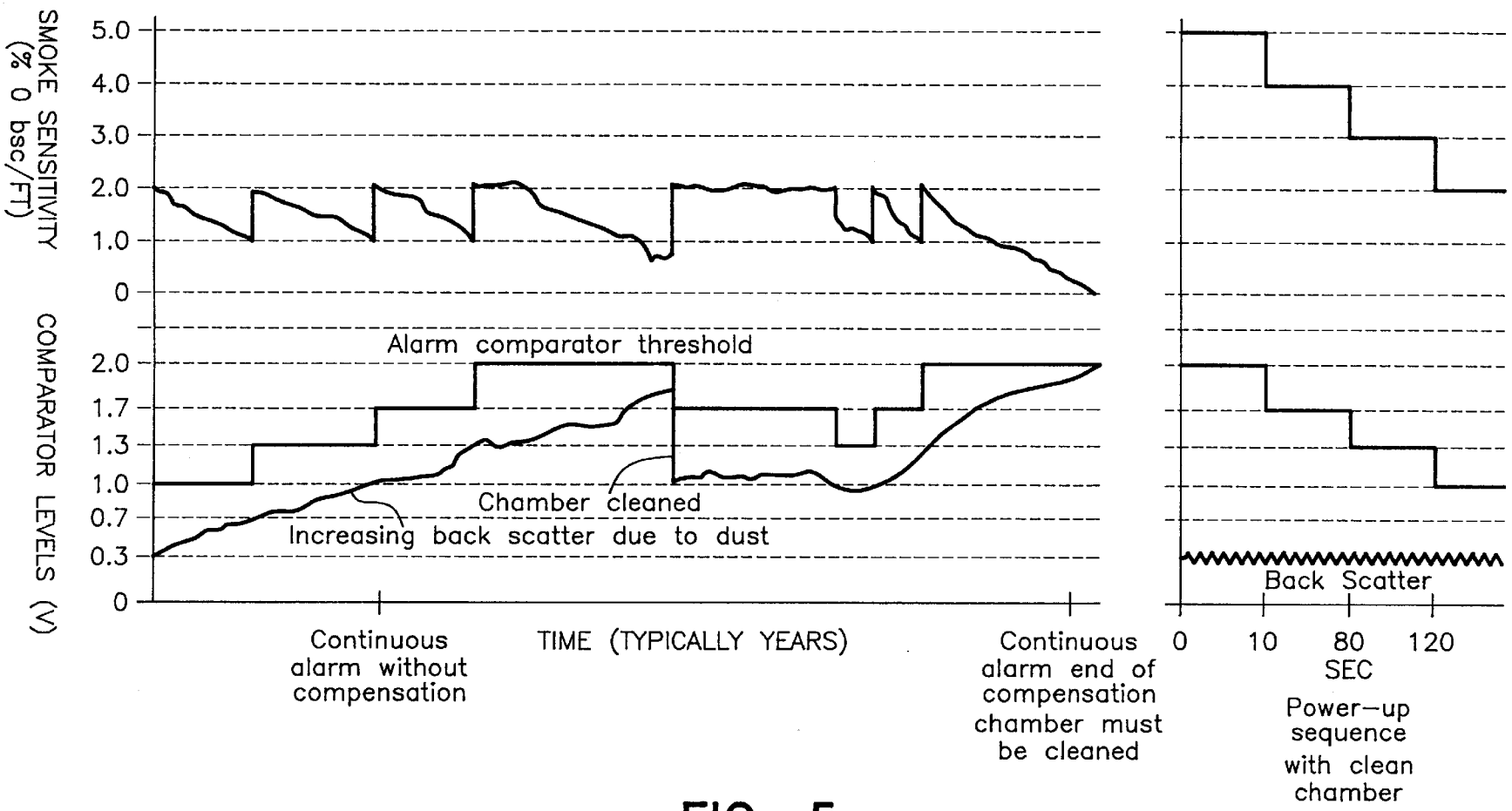
FIG. 5 is a set of plots illustrating dynamic adjustment of sensitivity in response to contamination.

The sensitivity of the alarm device is a function of the density of smoke requited to bring the level of light sensed at the photo-detector 3 to a level at which the voltage output of the photo-detector 3 exceeds an alarm threshold set by the comparator 10. At start of use the alarm threshold is set by the logic block 2 activating the voltage reference A from the set up references A, B, C, and D. Referring to FIG. 5, this level is indicated by the unit 1.0 in the plot of comparator levels against time. On the upper plot, this corresponds to a value of 2.0 for smoke sensitivity (% Obsc/ft). On this upper plot, there is an inverse relationship between the vertical axis values and sensitivity i.e. the lower the value the higher the sensitivity. As stated above, the internal surfaces of the walls of the optical chamber 50 are black so that they absorb light and when smoke is present it causes a tiny fraction of the light (less than one part in 100,000) to reflect onto the photo detector 3. As dust (non-black) settles on the chamber walls it also scatters light onto the photo detector 3. Thus over time (typically years) there is increasing back-scatter due to dust contamination and a situation would be reached where this level reaches a value of 1.0 V on the plot of FIG. 5 at which the device would alarm continuously. This is avoided by a contamination compensation technique implemented by the comparators 10, 11, and 12 together with the logic block 2.

The IRED 5 is activated for 100 microseconds every 10 seconds and the resulting sensor voltage output is fed into the three comparator circuits 10, 11, and 12. If the output from the photo detector 3 exceeds the alarm threshold three times as recorded in its counter, the logic block 2 alarms. Use of three samples helps to ensure that noise glitches or light flashes do not cause false alarms. When the fist count is recorded, the LEDs is activated after only 2.6 secs. and after the second count after only 1.3 secs. This ensures that the device goes into alarm at worst after 13.9 secs, (10+2.6+1.3 secs) instead of 30 secs (10 secs+10 secs+10 secs). Another feature contributing to integrity of operation of the device is that capacitors connected to a comparator for the photo detector 3 essentially store the ambient light signal level in the chamber prior to the IRED 5 being activated. Thus, the device only reacts to changes in the light level from the steady state level.

The logic block 2 sets a sensitivity-decrease threshold in the comparator circuit 11 of half of the current alarm threshold set in the comparator circuit 10. The initial value is 1.0 V. Every time the comparator circuit 11 detects a value above this sensitivity-decrease threshold it increments its six-hour counter 13. When this counter reaches a value reflecting six hours (indicating that the sensitivity-decrease threshold has been exceeded for six hours), the logic blocks 2 closes an analogue switch in the comparator circuit 10 to increase the alarm threshold value to a next reference, 1.3 V. Thus, by increasing the alarm threshold from 1.0 V to 1.3 V the logic block 2 has decreased sensitivity because the gap between the level of light caused by contamination and the alarm threshold has been increased in step fashion as illustrated in the plots of FIG. 5. In this plot, the first increase is from a level of 1.0 V to 1.3 V, with a consequent smoke sensitivity of 2.0, which is less sensitive than the value of 1.0 which had been reached. As illustrated in the plots of FIG. 5, this is repeated up to a maximum of two more times in which the minimum interval between the sensitivity decreases is six hours, however, it is typically much longer and may be years. The logic block 2 activates the LED connected to the terminal 8 to two flashes 0.5 seconds apart every 14 seconds to indicate that the device should be cleaned. This is of benefit to maintenance people as they can concentrate on cleaning the devices which are excessively contaminated. In some installations some devices rarely need to be cleaned as they are in clean environments, whereas others need much more regular cleaning (such as those located near kitchens). This allows much better utilisation of a maintenance person's time and it helps to ensure that the devices are more reliable as they are cleaned in a more timely manner. This also avoids the nuisance of the entire system going into alarm due to one contaminated device.

The photo detector output is also compared in the comparator circuit 12 every 10 seconds with a sensitivity-increase threshold which may, for example, be 0.5 V. If the level is lower than this for four samples, this indicates that the unit has probably been cleaned. The logic block 2 therefore increases the sensitivity by reducing the alarm threshold in the comparator circuits 10, unless of course it is at the most sensitive level already. There may be three steps up in sensitivity (down in alarm threshold), as indicated by the right hand plots of FIG. 5. An occurrence of the level being below the alarm sensitivity increase threshold increments a counter 14 in the comparator circuit 12. However, in this case a value of 4 is sufficient to cause the logic block 2 to increase the sensitivity. Thus, the sensitivity is increased in 40 second periods. Thus, the unit will only decrease sensitivity in intervals of at least six hours to ensure that it takes account of slowly-developing fires, while on the other hand it would increase sensitivity within 40 seconds.

The plot on the tight hand side of FIG. 5 shows sensitivity being increased in successive steps. This typically arises on power-up because the logic block 2 automatically sets the alarm threshold at the highest level (for lowest sensitivity) on power-up. If the chamber is clean it will automatically increase the sensitivity every 40 seconds until the correct sensitivity level is established. Thus, it takes only a maximum of 120 seconds to establish the required sensitivity after power-up. This avoids a problem which would arise if the unit is powered-down for a reason such as maintenance. This problem is that the device could take up to 18 hours of alarm sounding to re-establish the correct comparator settings if it were to adjust sensitivity from the highest level downwards with increased settings on the alarm threshold in six-hour steps. This would cause the battery to become depleted and would an extreme nuisance to users.

Referring again to FIG. 1, the logic block 2 is connected to terminals 9 which include an interconnect terminal. The logic block 2 sends a high signal on the interconnect line when it is sounding an alarm or when the test/hush button 7 is pressed. This causes all of the alarms connected to the interconnect line to sound at the same time. The logic block 2 is also programmed to maintain the interconnect line high for a period of four seconds after the test button is released This means that the interconnected alarms will continue sounding after the local horn has switched off. Therefore, a person checking a system by pressing the test button on a first device can confirm that this device is sounding and that its LED is flashing. He or she can also hear the other interconnected devices during the four second interval after the test button is released. This was not the case previously as the other devices have sounded for the same period as the local device and so their sound drowned out the sound of the local device. Thus, the device allows a maintenance person to check integrity of the interconnect line connections in a very simple manner. The logic block 2 also stores an internal register memory flag when it goes into alarm mode. The block 2 is programmed to activate the sound emitter when it is next tested on the terminal 7 with a horn modulation with a period of 330 msec and an on-time of 250 msecs. However, if the memory flag has been set (indicating that the device has sensed smoke since it was last tested) the on-time is reduced to 10 msecs. The memory flag is then reset after the test button is released. Thus, the device provides an indication that it has detected smoke since it was last tested with out the need to consume the power which would be involved in activating an output indicator continuously. There is no extra power required to provide this indication as it is simply a change of modulation when next tested. This facility is of enormous benefit to maintenance people trying to troubleshoot apparently faulty systems. Defective devices giving intermittent alarms can be easily identified, as can devices which are badly sited or causing excessive nuisance alarms. This facility allows maintenance people to simple replace the defective device (instead of say replacing all twelve devices in a system). It also allows maintenance people to rapidly get to the root of a problem, thus reducing costs. Another benefit is that manufacturers need to replace only genuinely defective devices and not all devices in the system.

The invention is not limited to the embodiments described, but may be varied in construction and detail. For example, the sensitivity may be adjusted by changing the current in the infra red diode 5 rather than by changing the alarm threshold level. However, the latter is a very simple and effective way of achieving sensitivity adjustment. Also, the memory indication of smoke sensing since a previous test may alternatively be achieved by intermittent activation of an LED upon testing.

What is claimed is:

1. A smoke alarm device comprising:

a housing having vents to allow flow of surrounding air into and out of the housing, an alarm indicator means, a smoke sensor, and a control circuit including means for monitoring a sensor output from said smoke sensor, for determining if smoke is present, and for activating the alarm indicator if it is present, the sensor includes a light emitter, a light emitter drive circuit, and a photo-detector;

the sensor light emitter drive circuit, the photo-detector, and the control circuit are incorporated in a single discrete integrated circuit, said integrated circuit further incorporating a gain amplifier and comparators connecting the photo-detector to a logic block internally within the discrete integrated circuit;

the housing includes lower and top parts, the lower part includes an optical chamber having openings communicating with the vents, and including means for mounting in the top part the integrated circuit adjacent to the optical chamber at a position in which the photo-detector has a field of view within the optical chamber;

the light emitter and the integrated circuit are mounted at opposed sides of the optical chamber;

the optical chamber includes a barrier blocking a direct path between the light emitter and the photo-detector, said barrier including a plurality of side-by-side walls; and the optical chamber includes an optical element having means for providing a field of view intersecting at a volume of space light emitted by the light emitter, and focusing said light onto the photo-detector.

2. The alarm device as claimed in claim 1, wherein the integrated circuit is an ASIC.

3. The alarm device as claimed in claim 1, wherein the integrated circuit further comprises a shielding case for the integrated circuit, said case including a window to provide a field of view for the sensor.

4. The alarm device as claimed in claim 3, wherein the case comprises an integral earth terminal.

5. The alarm device as claimed in claim 1, wherein the control circuit comprises means for dynamically adjusting sensitivity in response to sensing of back-scatter arising from dust contamination within the optical chamber.

6. The alarm device as claimed in claim 5, wherein said sensitivity adjustment means comprises means for decreasing sensitivity only at least three hours after contamination has reached a sensitivity-decrease threshold level.

7. The alarm device as claimed in claim 6, wherein the sensitivity adjustment means comprises means for incrementing a counter every time contamination above said sensitivity-decrease threshold is detected and means for decreasing sensitivity when the counter value reaches a counter maximum value.

8. The alarm device as claimed in claim 6, wherein said sensitivity-decrease threshold level is a proportion of an alarm threshold level which sets the alarm sensitivity.

9. The alarm device as claimed in claim 5, wherein the sensitivity adjustment means comprises means for increasing sensitivity in response to contamination dropping below a sensitivity-increase level.

10. The alarm device as claimed in claim 9, wherein the sensitivity adjustment means comprises means for increasing sensitivity within one minute of contamination dropping below the sensitivity-increase level.

11. The alarm device as claimed in claim 9, wherein the sensitivity adjustment means comprises means for increasing sensitivity in successive steps separated by less than one minute.

12. The alarm device as claimed in claim 5, wherein the sensitivity adjustment means comprises means for adjusting sensitivity by changing a sensor output alarm threshold level.

13. The alarm device as claimed in claim 5, wherein the sensitivity adjustment means comprises means for automatically setting the sensitivity at the least sensitive level on power-up.

14. The alarm device as claimed in claim 5, wherein the control circuit comprises means for generating a user output indicating that the optical chamber needs to be cleaned if the contamination reaches a warning level.

15. The alarm device as claimed in claim 14, wherein said user output is a flashing LED.

16. The alarm device as claimed in claim 1, wherein the control circuit comprises means for storing a flag when smoke is detected, and for subsequently, after the smoke has cleared, generating a memory indication that smoke was sensed.

17. The alarm device as claimed in claim 16, wherein the control circuit comprises means for generating the memory indication in response to user testing of the device.

18. The alarm device as claimed in claim 17, wherein the alarm indicator means comprises a sound emitter, and the memory indication is activation of the sound emitter at a different frequency than for indicating that smoke is being sensed.

19. The alarm device as claimed in claim 16, wherein the control circuit comprises means for resetting the flag upon testing.

20. The alarm device as claimed in claim 1, wherein the control circuit comprises an interconnect interface, and means for directing the interface to transmit a signal on an interconnect line for a time duration after it has stopped activating the alarm indicator means.

21. The alarm device as claimed in claim 1, wherein the control circuit comprises means for counting occurrences of a photo detector output exceeding an alarm threshold, and for activating an alarm mode when the count reaches a pre-set value.

22. The alarm device as claimed in claim 21, wherein the control circuit comprises means for sampling light at periodic intervals and for decreasing said intervals after the first occurrence of the output exceeding the alarm threshold.

* * * * *